United States Patent [19]

Carlson

[11] Patent Number: 4,779,312

[45] Date of Patent: Oct. 25, 1988

[54] APPARATUS TO AID IN APPLYING AN ARTICLE OF JEWELRY AROUND THE WRIST

[76] Inventor: Joan D. Carlson, 4245 Erress Blvd., Pensacola, Fla. 32505

[21] Appl. No.: 115,519

[22] Filed: Nov. 2, 1987

[51] Int. Cl.[4] ..... A44B 21/00

[52] U.S. Cl. ..... 24/3 R; 24/3 A; 24/304

[58] Field of Search ..... 24/3 R, 3 A, 3 K, 3 E, 24/304, 444, 447; 63/2

[56] References Cited

U.S. PATENT DOCUMENTS

| | | | |
|---|---|---|---|
| 1,164,697 | 12/1915 | Alsop | 24/3 R |
| 2,176,052 | 10/1939 | Beyer | 24/3 A |
| 3,016,589 | 1/1962 | Collins | 24/3 A |
| 3,242,540 | 3/1966 | Mitchell | 24/3 K |
| 3,430,300 | 3/1969 | Doan | 24/304 |
| 4,457,053 | 7/1984 | Niwa | 24/304 |
| 4,498,615 | 2/1985 | Johnson | 24/444 |
| 4,706,914 | 11/1987 | Ground | 24/447 |

*Primary Examiner*—Victor N. Sakran

*Attorney, Agent, or Firm*—George A. Bode; Mason M. Campbell

[57] ABSTRACT

An apparatus for applying an article of jewelry around an individual's wrist comprising: a base; an arcuate arm connected at its proximate end to the proximate end of the base member and extending upwardly perpendicular to the base and then curving and extending over the base to terminate in a horizontal plane, thus defining a substantially horizontal portion of the arcuate arm, the horizontal portion being spaced vertically from the base a distance sufficient to accommodate the wearer's wrist, the horizontal portion of the arcuate arm having a channel provided therein and transversely thereof and positioned near the distal end thereof; and a means provided in the channel for releasably suspending the article of jewelry from the horizontal portion of the arcuate arm, whereby the article of jewelry is maintained in the spacing between the horizontal portion of the arcuate arm and the base member.

3 Claims, 1 Drawing Sheet

APPARATUS TO AID IN APPLYING AN ARTICLE OF JEWELRY AROUND THE WRIST

BACKGROUND OF THE INVENTION

1. Field of the Invention

The present invention relates to an apparatus to aid in securing various jewelry articles around the wrist. The present invention more particularly, relates to such an apparatus comprised of a base member, an integral acurate arm which curves and extends thereover and has a jewelry article suspending means to place the jewelry article in a position so that the non-jewelry wearing hand is free to fasten the jewelry article around the wrist.

2. General Background

Individuals when wearing jewelry articles, such as loose link or flexible bracelets, around the wrist, often find difficulty in securing the same about the wrist. The articles tend to slip and are therefore, often dropped. The present invention is contructed to suspend the jewelry article and allow the jewelry-wearing wrist to be placed in position to pass the item therearound, and then, with the free hand fasten the jewelry article by any conventional clip means.

U.S Pat. No. 3,016,589, entitled "Clip" issued to P. T. Collins and discloses a device to embrace the wrist for the purpose of aiding and securing a bracelet therearound. This device is applied to the wrist with one end of the device holding one end of the bracelet which is to encircle the wrist. A hook portion is passed through a link in the bracelet, and thus, the bracelet is fixed at one end while the other loose end is passed around the wrist end where a clasp is secured.

U.S. Pat. No. 3,242,540, entitled "Bracelet Attaching Device" issued to R. J. Mitchell and teaches a bracelet attaching device having an elongated body portion having a finger band on one end and a hook on the opposite end having a downwardly extending member and a return arm. The device is rigid so it will keep the hook at a substantially fixed position on the wrist when applying the bracelet.

The foregoing patents show apparatus to aid in applying jewelry articles around the wrist having hooks and attaching to the jewelry-wearing arm. These devices fail, however, to disclose the apparatus of the present invention which uses no hooks or attachments to the jewelry wearing hand, but suspends the article of jewelry from an arcuate arm extending over a base and allows the wearer to place the jewelry wearing wrist in a position to pass the article of jewelry therearound and frees the other, non-jewelry wearing hand, to secure the jewelry article.

GENERAL DISCUSSION OF THE PRESENT INVENTION

The preferred embodiment of the present invention is an apparatus to aid in applying an article of jewelry to the wrist comprising a base, an arcuate arm connected at its first end to one end of the base and curving and extending over the base to terminate in a horizontal portion thereof, the horizontal portion being spaced from the base a distance sufficient to accommodate the wearer's wrist; a channel is provided within and transversely of the horizontal portion and has therein means for suspending the jewelry article from the horizontal portion, whereby the article is maintained in the spacing between the horizontal portion and the base.

It is an object of the present invention to provide an apparatus to aid in applying an article of jewelry to the wrist without the use of any hooks or pins.

It is a further object of the present invention to provide such an apparatus to aid in applying an article of jewelry to the wrist having a base and arcuate arm curving and extending over the base to terminate in a horizontal portion, with means for suspending the jewelry article from the horizontal portion thereby freeing one hand to fasten the jewelry article.

It is a further object of the present invention to provide an apparatus to aid in applying an article of jewelry to the wrist that is simple and inexpensive to manufacture, yet which may be quickly utilized to aid in applying an article of jewelry around the wrist.

It is a further object of the present invention to provide an apparatus to aid in applying an article of jewelry to the wrist which is attractive in appearance, easily carried in a traveling case or the like, and easily used.

It is a further object of the present invention to provide an apparatus to aid in applying an article of jewelry to the wrist that is inexpensive to purchase.

BRIEF DESCRIPTION OF THE DRAWING

For a further understanding of the nature and objects of the present invention, reference should be had to the following detailed description, taken in conjunction with the accompanying drawing in which like parts are given like reference numbers and, wherein.

DETAILED DESCRIPTION OF THE PREFERRED EMBODIMENT

Figure 1:
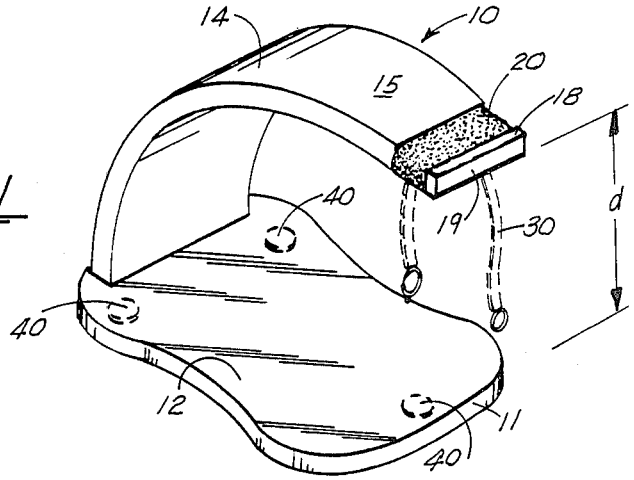
FIG. 1 is a perspective view of the preferred embodiment of the apparatus of the present invention with an article of jewelry (in phantom) suspended from the horizontal portion of the arcuate arm.
Figure 5:
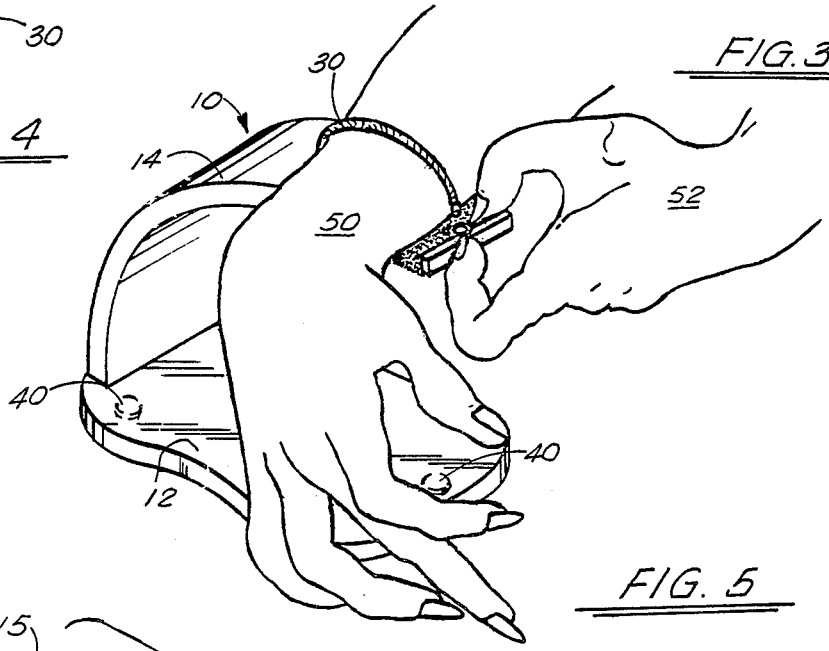
FIG. 5 is a perspective view of the emodiment of FIG. 1 illustrating an application thereof.

FIGS. 1 and 5, best illustrate the perferred embodiment of the apparatus of the present invention designated generally by the numeral 10. Apparatus 10 for aiding and applying an article of jewelry around the wear's wrist is comprised of an elongated base member 12, having an arcuate arm member 14 connected thereto. In the perferred embodiment of FIGS. 1 and 5, base member 12 and arcuate arm member 14 are integrally formed. Base member 12 and arcuate arm member 14 are connected to each other at the first (or proximate) end of each member. As best seen in FIG. 1, arcuate arm member 14 extends from its proximate end at first upwardly substantially perpendicular to base member 12, and then curves and extends over base member 12 to terminate in a horizontal portion 15. Horizontal portion 15 is substantially parallel to base member 12 and spaced a distance "d" therefrom sufficient to accommodate the wrist 50 of the wearer therebetween. The terminus or distal end 19 of arcuate arm member 14 is positioned substantially above and laterally even with the leading edge 11 of base member 12.

Figure 2:
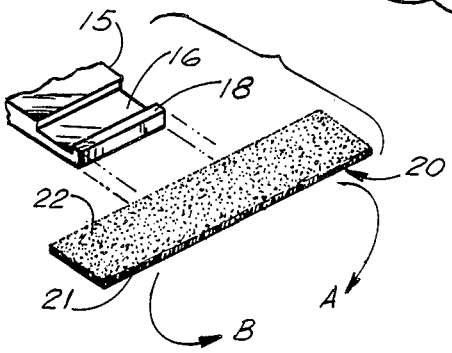
FIG. 2 is a partial perspective view of the distal end of the horizontal portion of the arcuate arm of the embodiment of of FIG. 1.

As best seen in FIGS. 1 and 2, provided in horizontal portion 15 of arcuate arm member 14 near its proximate end 19 is a transversely disposed channel or groove 16 which defines lip portion 18.

Figure 4:
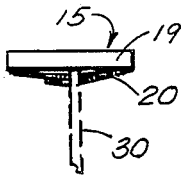
FIG. 4 is a distal end view of the horizontal portion of the arcuate arm of the embodiment of FIG. 1, with an article of jewelry (in phantom) suspended therefrom.
Figure 3:
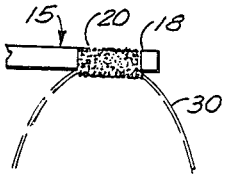
FIG. 3 is a partial side view of the horizontal portion of the arcuate arm of the embodiment of FIG. 1.

As best seen in FIGS. 1, 2 and 3, fastening means 20 in the form of a flexible velcro strip is adhesively mounted at a central portion of its underside 21 to the upper surface of transverse channel 16. Velcro strip 20 has its entire under surface 21 provided with preferably the female (loop) portion thereof. The upper surface 22 of velcro strip 20 is preferably the male (hook) portion thereof. (Of course, in an alternate embodiment the male and female portions can be reversed). As a means for releasably suspending article of jewelry 30 from horizontal portion 15 of arcuate arm member 14, as best illustrated in FIG. 1, velcro strip 20 is wrapped around the article of jewelry 30 (in the directions of ARROWS A and B) and the marginal edges or ends made to overlap, and then, by merely pressing the male fastener upper portion 22 against the female fastener lower portion 21 (or pressing female against male) at the desired location therealong, the article of jewelry 30 is suspended from horizontal portion 15 of arcuate arm member 14, as best shown in FIGS. 1, 3 and 4. In this manner, article of jewelry 30 is maintained in the spacing between horizontal portion 15 of arcuate arm member 14 and base member 12.

In operation, article of jewelry 30 is held near unfastened strip of velcro 20 which has been adhesively fixed in transverse channel member 16, as described above. Velcro fastening means 20 is then wrapped around article of jewelry 30 and by folding the ends of the velcro fastening means 20 in the direction of ARROWS A and B and overlapping the marginal edges and pressing the male fastener portion 22 of one edge against the female fastener 21 of the other edge at the desired location and the article of jewelry 30 is suspending in the space between arcuate arm member 14 and base member 12. It can therefore be seen, as best illustrated in FIGS. 1, 3 and 4, that article of jewelry 30 will be suspended from horizontal portion 15 of arcuate arm member 14 in the spacing between arcuate arm member 14 and base member 12 (article of jewelry 30 shown in phantom in FIGS. 1, 3 and 4). With article of jewelry 30 in the (phantom) positions of FIGS. 1, 3 and 4, the individual slips her wrist 50 into the spacing between the horizontal portion 15 of arcuate arm member 14 and base member 12 with the article of jewelry 30 guided to partially envelope her wrist 50. The wearer then takes her free hand 52 and fastens article of jewelry 30 in the conventional manner.

An alternate application of the apparatus 10 of the present invention is illustrated in FIG. 5. After velcro fastener 20 is adhesively fastened to transverse channel 16 in horizontal portion 15 of arcuate arm member 14, article of jewelry 30 can be laid over fastening means 20 and then the edges of fastening means 20 can be folded over opposite the direction indicated in FIG. 2. By then pressing the female fastener portion of underside 21 against the male fastener portion of upper surface 22 at the desired location the article of jewelry 30 is attached to the upper surface of horizontal portion 15 of arcuate arm member 14. (The article of jewelry 30 is fixed at the opposite surface in FIGS. 1, 3 and 4). Then the wearer rests her wrist 50 on the upper surface of horizontal portion 15 of arucate arm member 14 with the article of jewelry thereunder and, wraps the article of jewelry 30 around her wrist 50 with free hand 52 and fastens article of jewelry 30 in the conventional manner.

Base member 12 of apparatus 10 is provided adhesively with means 40 for preventing the movement of apparatus 10 on the surface on which it is placed during use. Means 40 can take the form of portions or patches of felt or rubber which are known to have the capability of preventing movement on the surface of such pieces of furniture as tables, dressers, vanities or the like.

Because many varying and different embodiments may be made within the scope of the inventive concept herein taught, and because many modifications may be made in the embodiments herein taught, and because many modifications may be made in the embodiments herein detailed in accordance with the descriptive requirement of the law, it is to be understood that the details herein taught are to be interpreted as illustrative and not in a limiting sense.

What is claimed as invention is:

1. An apparatus for applying an article of jewelry around an individual's wrist comprising:

(a) a base member;

(b) an arcuate arm member connected at its proximate end to one end of said base member and extending at first upwardly substantially perpendicular to said base member and then curving and extending over said base member to terminate in a horizontal plane, thus defining a substantially horizontal portion thereof, said horizontal portion of said arcuate arm member being spaced vertically from said base member a distance sufficient to accommodate said wrist, said horizontal portion of said arcuate arm member having a channel provided therein and transversely thereof and positioned near the distal end thereof;

(c) means for releasably suspending said article of jewelry from said horizontal portion of said arcuate arm connected to said horizontal portion in said channel, whereby said article of jewelry is maintained in the spacing between said horizontal portion of said arcuate arm and said base member, said means further comprising a band provided in said channel, said band positioned to have overlapping marginal edges which thereby matingly engage each other to thereby provide suspension support for said article of jewelry provided within said band; and, (d) means for preventing movement of said apparatus during use, said means being provided on the lower surface of said base member.

2. An apparatus for applying an article of jewelry around an individual's wrist comprising:

(a) an elongated base member;

(b) an elongated arcuate arm member connected at its proximate end to the proximate end of said base member and extending at first upwardly substantially perpendicular to said base member and then curving and extending over said base member to terminate at a point above the distal end of said base member in a horizontal plane, thus defining a substantially horizontal portion thereof, said horizontal portion of said arcuate arm member being spaced vertically from said base member a distance sufficient to accommodate said wrist, said horizontal portion of said arcuate arm member having a channel provided therein and transversely thereof and positioned near the distal end thereof;

(c) means provided in said channel for releasably suspending said article of jewelry from said horizontal portion of said arcuate arm connected to said horizontal portion in said channel, whereby said article of jewelry is maintained in the spacing between said horizontal portion of said arcuate arm and said base member, said means further comprising a band provided in said channel, said band positioned to have overlapping marginal edges which thereby matingly engage each other to thereby provide suspension support for said article of jewelry provided within said band; and, (d) means for preventing movement of said apparatus during use, said means being provided on the lower surface of said base member.

3. A method for applying an article of jewelry around an individual's wrist comprising:

(a) providing an apparatus having an elongated base member, an elongated arcuate arm member connected at its proximate end to one end of said base member and extending at first upwardly substantially perpendicular to said base member and then curving and extending over said base member to terminate in a horizontal plane, thus defining a substantially horizontal portion thereof, said horizontal portion of said arcuate arm member being spaced vertically from said base member a distance sufficient to accommodate said wrist, said horizontal portion of said arcuate arm member having a channel provided therein and transversely thereof and positioned near the distal end thereof, and means for releasably suspending said article of jewelry from said horizontal portion of said arcuate arm connected to said horizontal portion in said channel, whereby said article of jewelry is maintained in the spacing between said horizontal portion of said arcuate arm and said base member, said means for releasably suspending said article of jewelry further comprising a band provided in said channel, said band positioned to have overlapping marginal edges which thereby matingly engage each other to thereby provide suspension support for said article of jewelry provided within said band;

(b) releasably suspending said article of jewelry from said horizontal portion of said arcuate arm, (c) positioning said wrist in the spacing between said horizontal portion of said arcuate arm member and said base member, whereby said wrist is at least partially encircled by said article of jewelry;

(d) fastening said article of jewelry about said wrist; and, (e) providing means for preventing movement of said apparatus during use, said means being provided on the lower surface of said base member.

* * * * *